US005284357A

United States Patent [19]

Tinkler

[11] Patent Number: 5,284,357

[45] Date of Patent: Feb. 8, 1994

[54] APPARATUS AND METHOD FOR DAMPING DEFLECTIONS AND VIBRATIONS IN SKIS

[76] Inventor: Michael R. Tinkler, 1130 Fifth St., Hood River, Oreg. 97031

[21] Appl. No.: 786,743

[22] Filed: Nov. 1, 1991

[51] Int. Cl.[5] ..... A63C 5/07

[52] U.S. Cl. ..... 280/602

[58] Field of Search ..... 280/602, 608, 609, 610, 280/607

[56] References Cited

U.S. PATENT DOCUMENTS

| | | | |
|---|---|---|---|
| 3,260,531 | 7/1966 | Heuvel | 280/11.13 |
| 3,747,947 | 7/1973 | Gunzel | 280/11.13 |
| 4,221,400 | 9/1980 | Powers | 280/602 |
| 4,300,786 | 11/1981 | Alley | 280/602 |
| 4,377,297 | 3/1983 | Staufer | 280/609 |
| 4,565,386 | 1/1986 | Crainich | 280/602 |
| 4,577,886 | 3/1986 | Chernega | 280/602 |
| 4,592,567 | 6/1988 | Sartor | 280/602 |
| 4,647,661 | 3/1987 | Girard | 280/602 |
| 4,679,813 | 7/1987 | Girard | 280/602 |
| 4,696,487 | 9/1987 | Girard | 280/602 |
| 4,697,820 | 10/1987 | Hagadi et al. | 280/602 |
| 4,740,009 | 4/1988 | Hoelzl | 280/602 |
| 4,804,700 | 2/1989 | Kuckler | 280/602 |
| 4,896,895 | 1/1990 | Bettosini | 280/607 |
| 4,951,960 | 8/1990 | Sadler | 280/607 |
| 5,040,818 | 8/1991 | Metheny | 280/609 |

FOREIGN PATENT DOCUMENTS

| | | | |
|---|---|---|---|
| 3315638 | 12/1983 | Fed. Rep. of Germany | 280/602 |
| 3919010 | 1/1990 | Fed. Rep. of Germany | 280/602 |
| 8801189 | 2/1988 | World Int. Prop. O. | 280/602 |

*Primary Examiner*—Richard M. Camby

*Attorney, Agent, or Firm*—Marger, Johnson, McCollom & Stolowitz

[57] ABSTRACT

An apparatus and method are provided for damping deflections and vibrations in a ski, and further for adjustably biasing a ski to enhance its performance. An elongated damping member is attached by one end to the upper surface of the ski, and bears at its other end on the upper surface of the ski to resist deflection of the end portion of the ski. The damping member may also be urged against the ski for biasing the end of the ski downward relative to the center of the ski. A resilient bearing pad may be disposed between the ski and the bearing end of the damping member. The damping member may be mounted at a lateral angle to differentially damp one side edge of the ski. The damping member is adjustable in its mounting to provide adjustable damping and biasing force. A second damping member may be mounted to the ski to damp and bias the opposite end of the ski in a like manner. A central damping member may be mounted to the center portion of the ski. A method of damping a ski is provided in which a member applies a damping force to the upper surface of the ski, and particularly at a longitudinal point along the ski where the ski primarily contacts the snow surface.

20 Claims, 5 Drawing Sheets

APPARATUS AND METHOD FOR DAMPING DEFLECTIONS AND VIBRATIONS IN SKIS

The present invention relates to the field of skis, and more particularly to the field of an apparatus and method for damping deflections and vibrations in skis.

BACKGROUND OF THE INVENTION

Skis, including snowboards, are by commercial necessity designed to accommodate a range of rider sizes, weights, riding styles, and skiing conditions. A particular model of ski therefore must meet numerous, and sometimes conflicting, design criteria.

For example, it is desirable for a ski to be stable and perform well in snow conditions ranging from powder to ice. An ideal powder ski is one with a relatively soft flex. On the other hand, a ski must be considerably stiffer, both longitudinally and torsionally, for satisfactory performance in icy conditions. At the same time, a particular ski must accommodate riders within a range of weights, while maintaining satisfactory camber characteristics. The camber of a ski determines what portion of the base is normally in contact with the snow, and further determines the turning characteristics of the ski. A ski is shaped to induce a turn when an edge is pressed into contact with the snow. To achieve this characteristic, the lateral edges are designed with sidecut in the center portion of the ski; that is, the lateral width of the ski is greater on the ends than in the center. The greater the amount of sidecut, the more readily the ski will turn when the edge of the center portion of the ski is pressed into contact with the snow. In this way, the camber and the flexing characteristics of the ski interact to determine the turning characteristics of the ski.

In addition, a ski is ideally designed to be responsive to changes in the snow surface, to skier inputs, and to isolate the skier from shock and vibration to the greatest degree possible. A responsive ski is one which is relatively stiff, and has a relatively low inertial moment. Unfortunately, stiffness and a low inertial moment detract from skier comfort by causing a ski to "chatter", that is for the tip and tail of the ski to rebound away from the snow, causing a momentary loss of control. A chattering ski also will transmit uncomfortable levels of vibration to the skier, predominantly through the binding into the skier's feet. These continual vibrations lead to fatigue, and possibly contribute to injuries.

Ski designers therefore attempt to design damping into a ski provide a degree of comfort and control for the skier. The damping usually is achieved by incorporating rubber, lead, or other deadening materials into the body of the ski. This solution adds to the weight and inertial moment of the ski, reducing its responsiveness. Additionally, a ski is typically designed with a less than ideal amount of stiffness as a further concession to skier comfort.

A satisfactory resolution of these problems is even more complicated in a type of ski known as a snowboard. A snowboard incorporates certain characteristics of a surfboard into a ski for use on snow. A rider stands on a snowboard facing generally to one side. The rider's feet are secured to the snowboard, one in front of the other, by two bindings in the center portion of the board. As a result of this riding position, the rider is unable to exert equal turning forces on both edges of the ski. When turning in one direction, the rider bears on one edge of the board with the toes and balls of his feet, while bearing with his heels when turning in the opposite direction. A rider is usually able to exert less turning force through the heels, leading to a reduced turning ability in one direction. Snowboard manufacturers have responded to this problem by designing "asymmetric" boards, i.e. having different amounts of sidecut in opposite edges of the snowboard. A greater sidecut in the "heel turning" edge of the board requires the rider to exert less force on the edge for a turning ability equal to the "toe turning" side of the board. The asymmetry of such boards detracts, however, from the straight line stability and speed of the board.

Design problems and resulting performance compromises such as these have lead to a efforts to design a ski damping system which allows a ski to reach a maximum level of performance under a range of snow and riding conditions, while providing maximum rider comfort, control, and turning ability.

An adjustable flex ski is disclosed in U.S. Pat. No. 4,577,886 to Powers in which three adjustable tensile members are embedded in the below the neutral plane in the body of the ski. The tensile members can be independently adjusted to change the flex characteristics of portions of the ski to adjust the stiffness of the ski. U.S. Pat. No. 4,221,400 discloses a ski having pre-stressed, curved tensile members embedded in the ski body. The flex of the ski is adjusted by rotating the tensile members, thereby changing the orientation of the curvature of the tensile members, and their resistance to flexing vertically in relation to the ski.

A ski having adjustable camber-flattening resistance is disclosed in U.S. Pat. No. 4,300,786 to Alley. The '786 ski utilizes inserts disposed in internal voids in the central portion of the ski to adjust the camber-flattening resistance of the ski. U.S. Pat. No. 4,740,009 discloses a ski having an internal apparatus for adjusting the camber of the ski. The apparatus includes a sensor for sensing the degree of flex, and for controlling a motorized flex adjustment mechanism.

U.S. Pat. No. 3,260,531 to Heuvel discloses a terrain conforming ski in which the mechanism for mounting the binding to the ski permits fore and aft adjustment for redistributing the body weight of the skier to adapt the ski to different snow conditions.

U.S. Pat. No. 4,951,960 to Sadler and U.S. Pat. No. 4,565,386 to Crainich disclose skis having longitudinal slits extending partially along the length of the ski. In each case, the slit allows an additional edge to be brought to bear against the snow surface to enhance the turning characteristics of the ski.

A need remains, therefore, for an improved damping apparatus for a ski which provides for the ready adjustment of the longitudinal and torsional flex characteristics of a ski; which further provides for ready adjustment of the camber of a ski; and which further provides for effective damping of deflections and associated vibrations of the ski which contribute to a loss of control and skier discomfort, fatigue, and injury.

SUMMARY OF THE INVENTION

The present invention provides a damping apparatus for use on a ski having a skiing surface and an opposed upper surface. The damping apparatus includes an elongated damping member having a mounting end and a bearing end, a connector for interconnecting the damping member mounting end to the ski upper surface, and means for positioning said damping member bearing end for resisting deflection of the ski during skiing. The apparatus may also include a resilient bearing pad disposed between said damping member bearing end and said upper surface. The bearing end of the damping member is positioned relative to the upper surface of the ski to resist deflections of the ski during skiing. The damping member may be positioned at a variety of lateral angles on the ski to damp one side edge of the ski differently than the other. The bearing end may include a plurality of bearing fingers. The damping member is attachable to the ski without requiring tools.

The damping apparatus further includes means for biasing an end portion downwardly relative to said center portion, and means for biasing the left and right edges differentially. The apparatus may include means for adjusting the biasing force. The adjustment means may include interchangeable damping members, shims for varying the angle of the damping member, or a threaded adjuster for urging the mounting of a pivotally mounted damping member upward, thereby urging the bearing end downward against the ski.

The damping apparatus further comprises a resilient pad for mounting between said binding and said ski upper surface.

A method of damping a ski is provided which includes mounting a damping member on the ski for applying a damping force to the upper surface of the ski to resist deflection. A method is also provided for biasing a ski by urging the bearing end of the damping member downward agains the upper ski surface. The edges of the ski may be differentially biased.

The method may include providing interchangeable damping members having different tensile strengths to vary the damping or biasing of the ski. The method may include applying the damping force to the ski at a longitudinal point at which the ski contacts the snow.

DETAILED DESCRIPTION OF THE PREFERRED EMBODIMENTS

Figure 1:
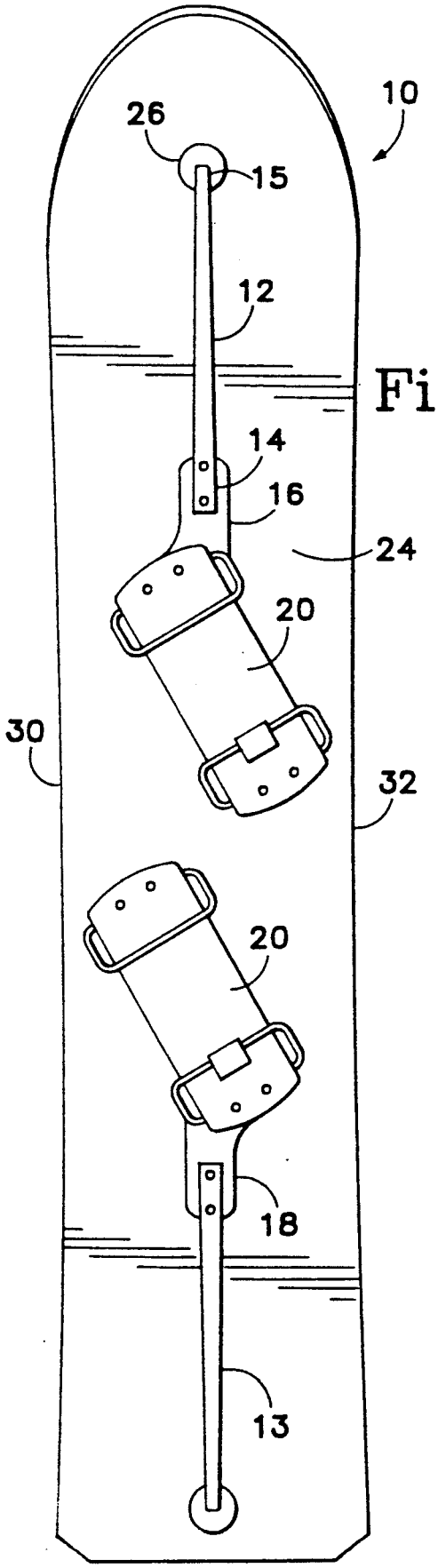
FIG. 1 is a plan view of a snowboard-type ski according to one embodiment of the present invention.
Figure 2:
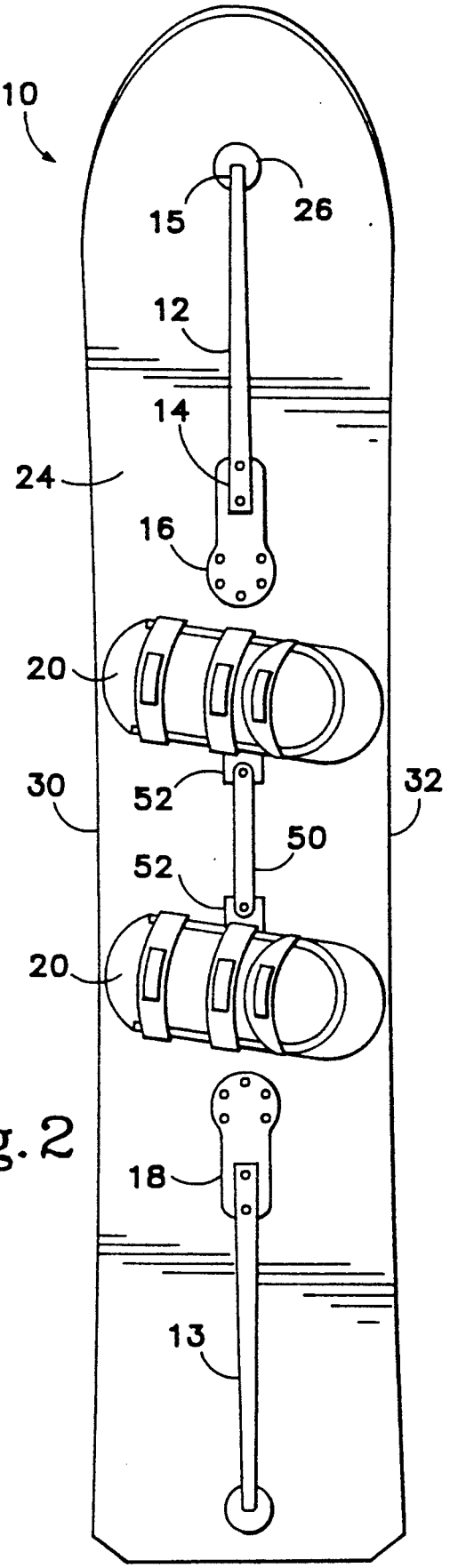
FIG. 2 is a plan view of a snowboard-type ski according to a second embodiment of the present invention.
Figure 3:
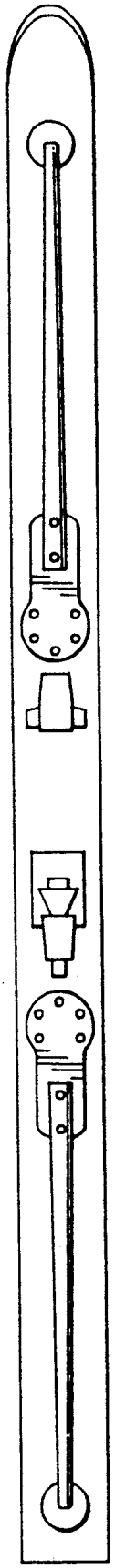
FIG. 3 is a plan view of an alpine-type ski according to a third embodiment of the present invention.

Referring now to FIGS. 1 and 2, a snowboard-type ski is shown generally at 10. Ski 10 is fitted with a front damping member 12 and a rear damping member 13. Front damping member 12 is fixed at its mounting end 14 to front connector 16, and rear damping member 13 is similarly fixed to rear connector 18. Damping members 12 and 13 may be formed from any material having suitable tensile strength properties, with the preferred material being a combination of unidirectional carbon fiber, also known as graphite fiber, and Kevlar ® fiber, manufactured by duPont, with a bidirectional S glass and epoxy resin.

Figure 5:
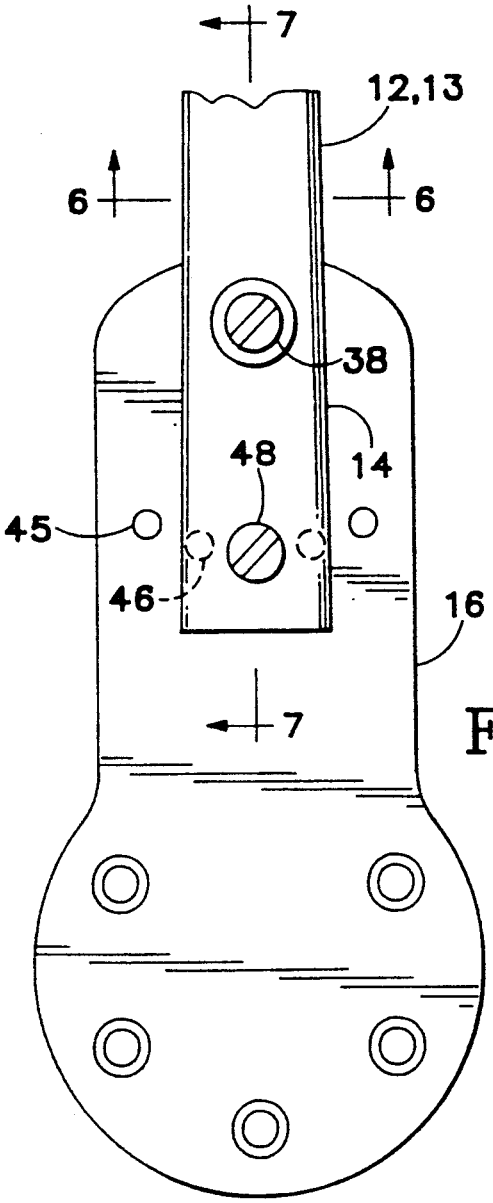
FIG. 5 is an enlarged plan view of one of the FIG. 2 connectors with a damping member attached, and showing one method of providing various angled mounting positions for the damping member.

Although not required, each of damping members 12 and 13 is preferably tapered from mounting end 14 to its bearing end 15. A tapered shape provides a progressive damping action which is considered an advantage. Small deflections are initially resisted with a relatively light damping force, which force progressively increases with the amount of deflection. Damping members 12 and 13 preferably have a cross-sectional shape as best seen in FIG. 5, although those skilled in the art will recognize that numerous cross-sectional shapes will suffice.

Bearing end 15 rests upon a resilient bearing pad 26, which in turn is bonded to ski upper surface 24. Bearing end 15 may also be positioned just above bearing pad 26 to provide damping only when ski 10 has deflected a predetermined amount. Bearing pad 26 may alternatively be bonded directly to bearing end 15. Bearing pad 26 is preferably formed from urethane rubber with a durometer of Shore 80A to 97A, one such product being sold under the Devcon ® trademark.

Figure 9:
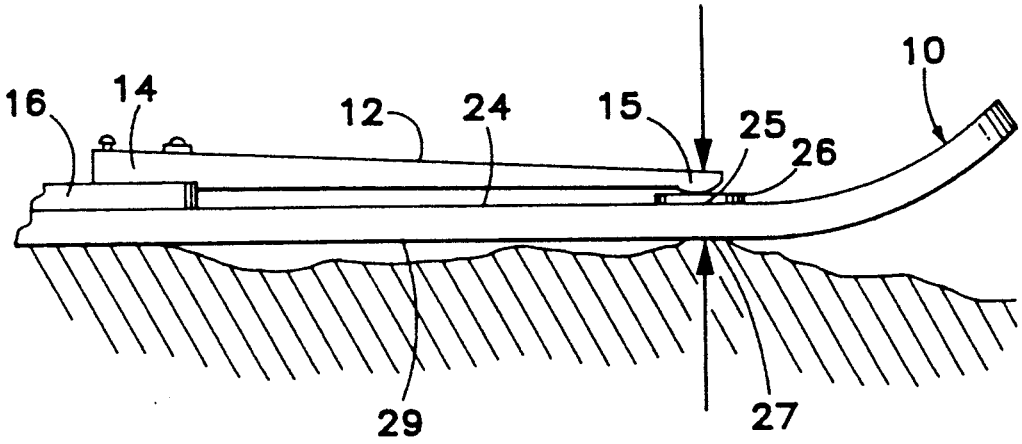
FIG. 9 is a side view of a ski in contact with the snow showing the preferred point of application of deflecting and damping forces.

Referring briefly to FIG. 9, bearing end 15 preferably exerts a damping force on ski 10 at a longitudinal point 25 of upper surface 24 directly opposite a point 27 on the ski bottom. Ski 10 contacts the snow primarily at point 27 along bottom surface 29, and a corresponding point at the rear of the ski. It is at therefore at point 27 that most deflections and vibrations are introduced into ski 10. It is at point 27 therefore where a damping force can be most advantageously and efficiently applied to resist deflection and damp vibrations of the ski. The importance of the application of damping force at precisely the point of contact of the ski with the snow has not heretofore been recognized nor practicable.

The force which bearing end 15 exerts on ski 10 can preferably be varied to adjust the damping characteristics of damping members 12 and 13, or to bias ski 10 downwardly at its end to induce a camber in ski 10. Additionally, damping members 12 and 13 may be mounted on ski 10 parallel to the longitudinal axis of ski 10, or at a lateral angle thereto. Mounting damping members 12 and 13 at a lateral angle permits one edge of the ski to be damped or biased differently than the opposite edge, or allows the front portion of one edge to be damped or biased differently than the rear portion. This is referred to herein as differentially biasing the left and right edges. As discussed above, this advantage is particularly useful in accommodating the uneven turning characteristics of a snowboard type of ski, or the ability of an inexperienced skier to turn better in one direction than the other.

Figure 6:
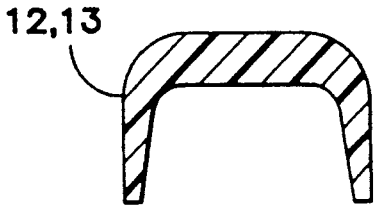
FIG. 6 is a end view in cross-section along line 6–6 of FIG. 5 of a damping member according to the present invention.
Figure 7:
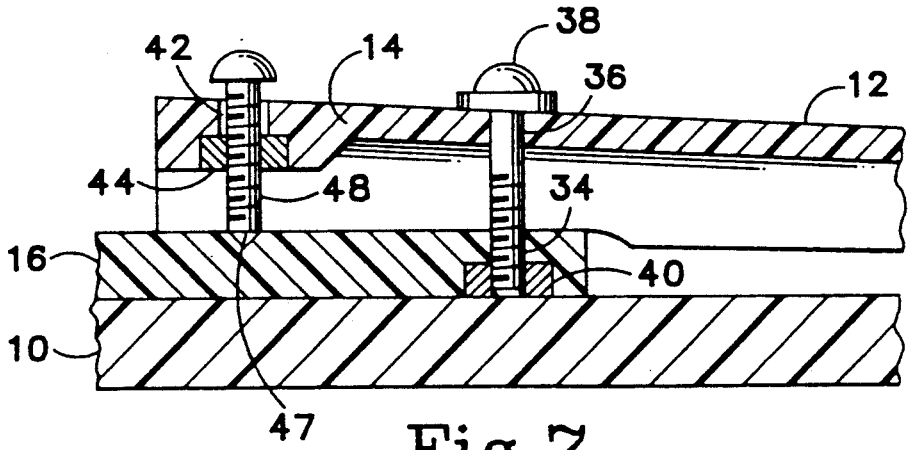
FIG. 7 is a side view in cross-section along line 7–7 of FIG. 5.

FIGS. 5–7 best show the features of connector 16 which provide for adjustment of the downward biasing force as well as the angled mounting of damping member 12. Connector 16 has mounting hole 34 therethrough, and damping member 12 has complementary mounting hole 36 therethrough. Mounting bolt 38 passes through holes 34 and 36, and engages mounting nut 40 embedded in connector 16. Damping member 12 has hole 42 therethrough, with adjusting nut 44 embedded therein. Connector 16 has a plurality of blind adjusting holes 46, three of which are holes 45, 46, 47 for receiving the end of adjusting screw 48. To mount and angularly position damping member 12, bolt 38 is inserted through holes 36 and 38 and engaged with nut 40. Damping member 12 is then positioned at a lateral angle. Adjusting bolt 48 is inserted into hole 42, engaged with adjusting nut 44, and then inserted into the adjusting hole 46 corresponding to the selected lateral angle. Adjusting bolt 48 is then further turned to bear against adjusting hole 47, urging bearing end 14 against upper surface 24 by lever action, with bolt 38 acting as the fulcrum. A resilient pad or other biasing means may alternatively be disposed between mounting end 14 and connector 16 or ski 10 to employ a similar leveraging principle for damping or biasing ski 10. Connector 18 and damping member 13 embody similar features. In this way, each edge can be individually "tuned", at both front and rear, for a particular skier and for particular conditions.

Other means for biasing the skis may be used. For example, a tapered shim, not shown, may be bolted between the damping member, like damping member 12, and connector 16 rather than using a pivoting approach as described above. Alternatively, a plurality of damping members can be provided, each of which resists flexing with a different force. Thus, each member provides a different damping response. The damping can be varied by providing members made from different materials, or made from the same material with a different thickness. Also, varying the length of each member so that the bearing end, like bearing end 15, assumes a different longitudinal position on the ski causes each member to produce a different damping response. When using different members, conventional wing bolts, not shown, can be used to mount each member through a pair of holes, similar to that shown in FIG. 7 but without the pivoting feature. This enables a skier to change the damping wherever he or she is without the use of tools.

Figure 8:
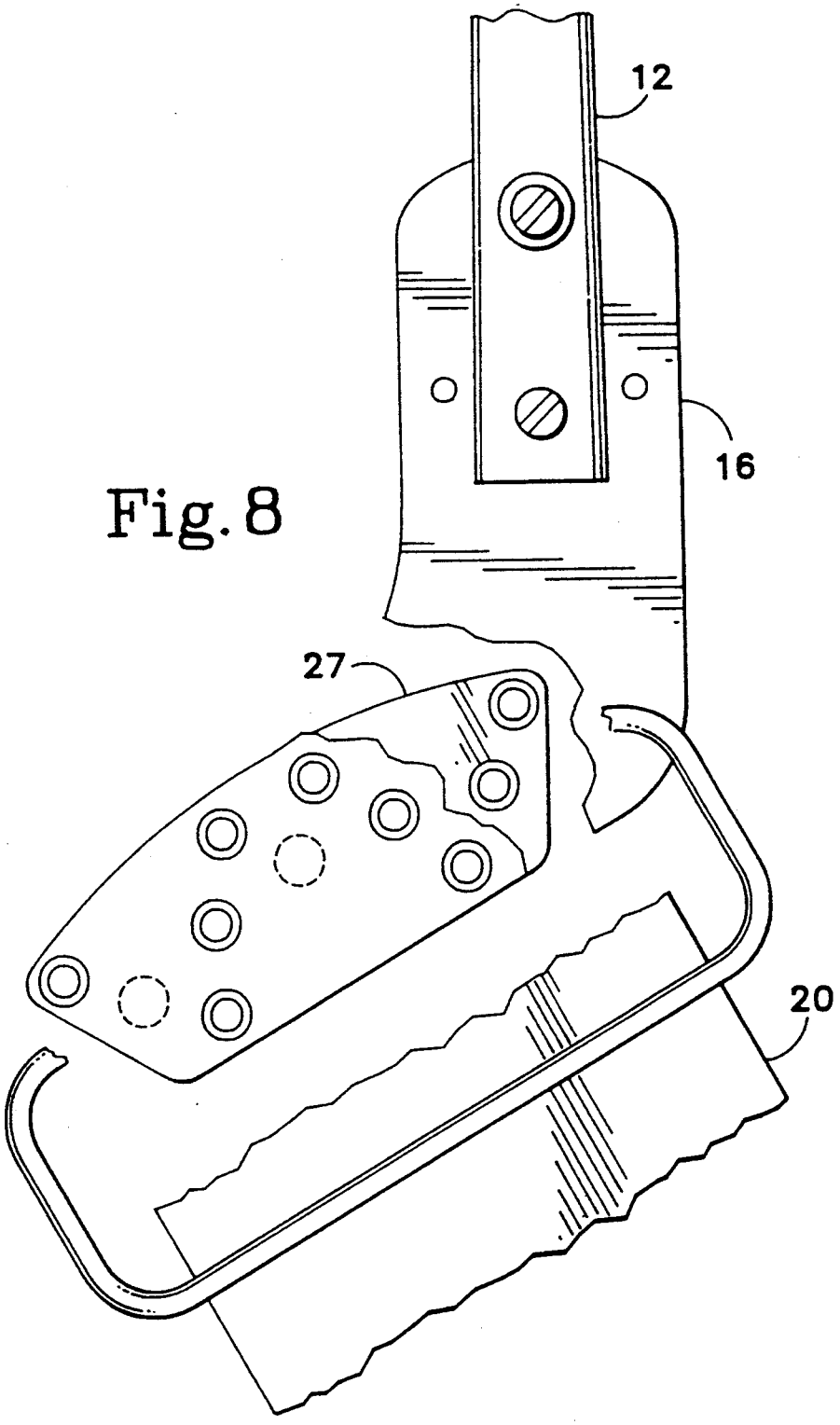
FIG. 8 is a plan view of an alternative embodiment of a connector in which the connector is attached to the ski.

As shown in FIG. 1, connectors 16 and 18 may be mounted on the ski beneath front binding 20 and/or rear binding 22, or alternatively, may be formed integrally with bindings 20 and 22. Preferably, as shown in FIG. 2, connectors 16 and 18 are mounted with screws (not shown) on the ski upper surface 24, and spaced slightly apart from bindings 20 and 22. Connectors 16 and 18 may be formed from any rigid, strong material, and are preferably formed from a polymeric composite material such as that used to make damping members 12, 13 as described above. In either case, a resilient binding damping pad 27 (FIG. 8) is preferably disposed beneath binding 20 to further reduce vibrations reaching the skier.

Figure 4A:
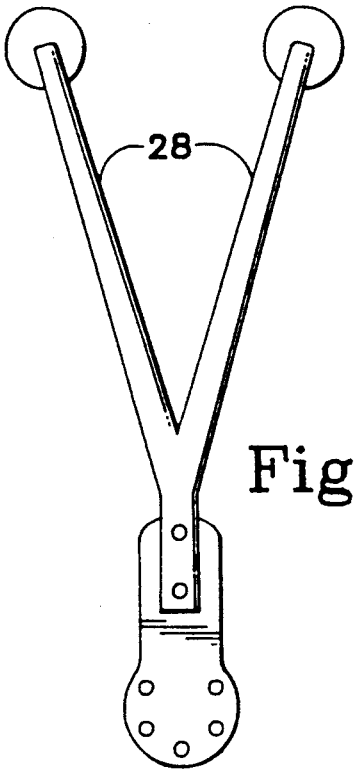
FIGS. 4A–4C are plan views of alternative embodiments of the damping member and connector according the present invention.
Figure 4C:
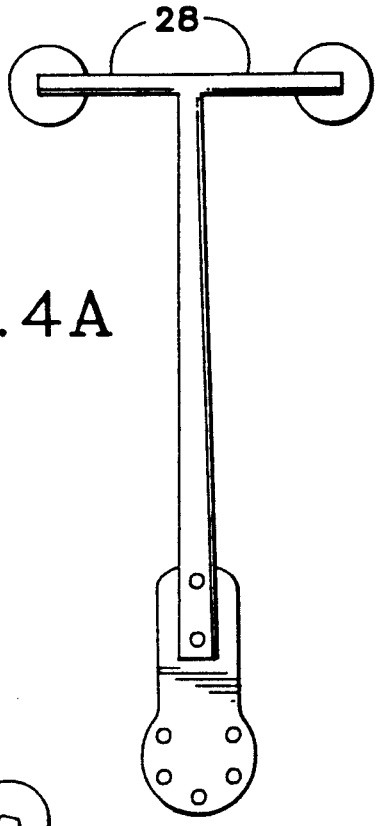
Figure 4B:
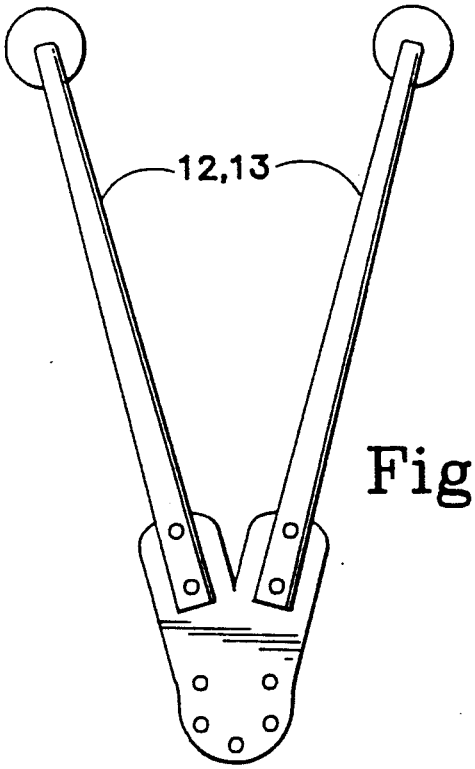

Turning to FIGS. 4A-C, damping members 12 and 13 and connectors 16 and 18 may alternatively be configured to provide two damping members at either end of board 10, or a single damping member having two bearing arms 28, each bearing against a bearing pad 26 as described above. These alternative embodiments allow for differentially damping and/or biasing the left edge 30 and right edge 32 of the ski, and further, allow damping and/or biasing the front portion of either edge of the ski differently from the rear portion of either edge as discussed above.

As shown in FIG. 2, a central damping member 50 may also be fitted. Central member 50 is rigidly attached at each end to ski 10 by connectors 52, which may or may not be integral with bindings 20. Central member is preferably mounted parallel with the longitudinal axis of the ski, but connectors 52 may alternatively allow for angled mounting of central member 50 as well. Member 50 is connected to the ski at the ends of the member to hold a predetermined level of camber in the ski. When mounting member 50, the ski is arched to the desired point and thereafter member 50 is fixed as shown in FIG. 2 to hold the camber.

While several embodiments of the present invention have been described and discussed in detail, it is understood that numerous changes and modifications may be made without departing from the scope of the claims.

I claim:

1. A damping apparatus for use on a ski having a skiing surface, an opposed upper surface, and left and right edges, said damping apparatus comprising:

an elongated damping member having a mounting end and a bearing end;

a first connector for interconnecting said damping member mounting end and the ski;

means for positioning said damping member bearing end for slidably engaging said ski upper surface for resisting vertical deflection of the ski during skiing; and differential biasing means for differentially biasing said left and right edges.

2. A damping apparatus according to claim 1 in which said differential biasing means includes said first connector having means for interconnecting said elongate damping member to the ski at a plurality of angles relative to a longitudinal axis of the ski.

3. A damping apparatus according to claim 1 in which said damping member bearing end includes a plurality of bearing fingers.

4. A damping apparatus according to claim 1 in which said first connector includes means for interconnecting said damping member mounting end to the ski without the use of tools.

5. A damping apparatus according to claim 2 in which said biasing means includes means for providing a plurality of selectable biasing forces.

6. A damping apparatus according to claim 1 in which said biasing means includes a plurality of interchangeable damping members.

7. A damping apparatus according to claim 1 in which said ski further comprises a ski boat binding mounted on said ski upper surface, and in which said damping apparatus further comprises a resilient pad for mounting between said ski boat binding and said ski upper surface.

8. A damping apparatus according to claim 5 in which said biasing means comprises:

a first vertical, internally threaded hole through said damping member mounting end;

means for pivotally mounting said damping member on said ski between said first hole and said bearing end; and a screw threaded through said first threaded hole, and having a lower end bearing against a surface beneath said damping member.

9. A ski according to claim 1 in which the damping apparatus further comprises:

a second elongated damping member;

means for mounting said second damping member on the ski upper surface in a generally longitudinal position over the center portion of the ski.

10. A damping apparatus for use on a ski having a skiing surface, an opposed upper surface having first and second end portions and a center portion, said damping apparatus comprising:

a first elongated damping member having a mounting end and a bearing end;

a first connector for interconnecting said first damping member mounting end to the ski;

means for positioning said first damping member bearing end for slidably engaging said ski upper surface first end portion for resisting vertical deflection of the ski during skiing;

biasing means for providing a plurality of selectable biasing forces for biasing said first end portion downwardly relative to said center portion;

said biasing means including means for interconnecting said damping member to the ski at a plurality of vertical angles relative to said ski upper surface.

11. A damping apparatus according to claim 10 in which said means for interconnecting said damping member to the ski at a plurality of vertical angles relative to said ski upper surface includes a shim disposed between said damping member and said first connector.

12. A damping apparatus according to claim 11 in which said shim is generally wedge-shaped.

13. A damping apparatus according to claim 11 in which said shim is formed from a resilient, vibration damping material.

14. A damping apparatus according to claim 10 in which said biasing means includes means for providing a plurality of selectable biasing forces while maintaining said damping member mounting end in a fixed longitudinal position on said ski.

15. A damping apparatus according to claim 10 further comprising:

a second elongated damping member having a mounting end and a bearing end;

a second connector for interconnecting said second damping member mounting end to the ski;

means for positioning said second damping member bearing end for slidably engaging said ski upper surface second end portion for resisting vertical deflection of the ski during skiing;

biasing means for providing a plurality of selectable biasing forces for biasing said second end portion downwardly relative to said center portion; and said biasing means including means for interconnecting said damping member to the ski at a plurality of vertical angles relative to said ski upper surface.

16. A method for damping a ski during skiing comprising the steps of:

providing a ski having an upper surface including first and second end portions and left and right edges;

providing a first elongate damping member having a mounting end;

connecting the first damping member by its mounting end to the ski upper surface;

positioning an opposite end of the first damping member for slidably engaging said ski upper surface first end for damping vertical deflections of the ski during skiing; and differentially biasing the left and right edges of the ski.

17. The method of claim 16 further comprising the step of replacing the first damping member with a second damping member having a resistance to deflection different from that of the first damping member.

18. The method of claim 16 which further comprises the step of positioning the opposite end of the first damping member for damping deflections of the ski during skiing further comprises positioning the opposite end at a longitudinal position to resist deflection at a point where the ski contacts the surface of the snow.

19. A method for damping a ski according to claim 16 wherein the step of differentially biasing the left and right edges of the ski comprises mounting the damping member at a lateral angle relative to a longitudinal angle of the ski.

20. A method for damping a ski according to claim 16 further comprising the steps of:

providing a second elongate damping member having a mounting end;

connecting the second damping member by its mounting end to the ski upper surface; and positioning an opposite end of the second damping member for slidably engaging said ski upper surface second end portion for damping vertical deflections of the ski during skiing.

* * * * *